United States Patent [19]

Ezaki et al.

[11] 4,409,322

[45] Oct. 11, 1983

[54] SILVER HALIDE PHOTOSENSITIVE MATERIAL

[75] Inventors: Atsuo Ezaki; Takeshi Murakami, both of Tokyo, Japan

[73] Assignee: Konishiroku Photo Industry Co., Ltd., Tokyo, Japan

[21] Appl. No.: 329,292

[22] Filed: Dec. 10, 1981

[30] Foreign Application Priority Data

Dec. 19, 1980 [JP] Japan ..... 55-181029

[51] Int. Cl.[3] ..... G03C 1/78

[52] U.S. Cl. ..... 430/523; 430/531; 430/537; 430/950

[58] Field of Search ..... 430/523, 531, 537, 950

[56] References Cited

U.S. PATENT DOCUMENTS

| | | | |
|---|---|---|---|
| 3,411,907 | 11/1968 | Whitmore et al. | 430/950 |
| 3,516,832 | 6/1970 | Earhart et al. | 430/950 |
| 3,697,277 | 10/1972 | King | 430/950 |
| 4,232,117 | 11/1980 | Naoi et al. | 430/523 |
| 4,287,299 | 9/1981 | Himmelmann et al. | 430/523 |

*Primary Examiner*—J. Travis Brown

*Attorney, Agent, or Firm*—Jordan B. Bierman; Linda Bierman

[57] ABSTRACT

A silver halide photographic material comprising a silver halide emulsion layer and a protective layer on one side of the support and a non-photosensitive back layer on the other side of the support. The amount of silver halide in the emulsion layer is not more than 30 mg/dm$^2$. A matting agent in indeterminate form is included in the protective layer and a substantially spherical matting agent is included in the back layer.

6 Claims, No Drawings

SILVER HALIDE PHOTOSENSITIVE MATERIAL

The present invention relates to a silver halide photosensitive material having the layer of which the two sides of the support contain matting agents respectively.

Generally speaking, a hydrophilic matter such as gelatin is used to serve as a binder for layer forming use, in a silver halide photosensitive material, and accordingly, under the conditions of highly elevated temperature and humidity the tackiness of said layer surface increases. The increase of tackiness thereof will cause various inconveniences such as that the outside surface of said layer is apt to be damaged when the photosensitive materials contact with each other or when a photosensitive material contacts with a device for processing it, and that an electrostatic trouble is apt to be caused by an electric discharge generated at the moment when a friction or peeling off is made between the said photosensitive materials themselves or between the photosensitive material and the device, and further that a satisfactory vacuum adhesion can hardly be obtained when a contact exposure to light is made.

Accordingly, as for the means for solving the aforesaid inconveniences, there has widely been put such a process into practice that the outside surface of said photosensitive material is matted by making use of a matting agent.

Normally, the said matting agent is contained in either one of the protective layer of nonphotosensitive back layer (hereinafter referred to as back layer) of a photosensitive materials, or in both of them, and thereby the tackiness of the contact surface of a photosensitive layer is decreased and the electric charge prevention effect and the vacuum adhesion thereof are improved.

And, when each of the contents of said matting agent is said protective layer and back layer is changed at the ratio of quantity from each other, the discrimination between the outside and the back side of a photosensitive material after developed, will become excellent. For example, in a photosensitive material for the graphic arts use, the working efficiency in the graphic arts processes is improved greater by making easier to discriminate the both sides of the photosensitive material and by making the mat degree higher by putting a lot of matting agents to use more onto the protective layer than that to use onto the back layer.

Now, in the case of a photosensitive material using silver halide in large quantities of the order of 80 mg/dm$^2$ of the amount of silver coated calculated in the terms of the amount of silver, it is possible to discriminate the two sides of the photosensitive material without using the aforesaid matting agent, because of the fact that the silver grains darkened after developed contribute to increase the mat degree of the outside surface layer. In the photosensitive materials having 40 mg–60 mg/dm$^2$ of the amount of silver coated, on the other hand, it is necessary to use matting agents because of the fact that it will become difficult to discriminate the two sides of the photosensitive material with only the contribution from the darkened silver grains. Especially, to keep pace with the recent times for saving natural resources, it has been laid emphasis on the developments of silver halide photosensitive materials in which, for example, the amount of silver coated is reduced to 30 mg/dm$^2$ of silver thereof. In the case that the protective layer of a silver halide photosensitive material having relatively small amount of silver like the aforesaid, is contained with the matting agent of which the amount is equivalent to that to be applied to a photosensitive material having the larger amount of silver coated (e.g., a photosensitive material containing 40 mg/dm$^2$ of the amount of silver) than that of the photosensitive material, some white pinholes (hereinafter referred to as pinholes) are strikingly come out on the solidly darkened area produced by the matting agent, after the development was made. This is because of the fact that the density is lowered partially at the portion where the matting agent remains after the development was made, and it it understandable that the maximum density of the solidly darkened area is lowered by having reduced the amount coated of silver and the pinholes are set off from others.

To cope therewith, there has been thought out the method as a means for reducing the pinholes caused in the silver-saved silver halide photosensitive materials as mentioned above, wherein the contents of matting agents in the protective layer thereof are reduced and the increased amount of matting agents is contained in the back layer thereof and the effect from the matting agents as mentioned above is thus obtained. In the photosensitive materials like the above, however, the contents of the matting agents are larger in the back layer than in the protective layer, therefore, the mat degree of the back layer surface becomes greater after the development was made and there is given the different result from that from the general practice of the aforesaid discrimination of the both sides of a photosensitive material.

Accordingly, it is an object of the present invention to provide a silver halide photosensitive material in which the amount of silver is remarkably saved and the pinholes do not cause; another object thereof to provide a silver halide photosensitive material in which the adhesive property, antistatic property and vacuum contact property thereof are improved; and a further object thereof to provide a silver halide photosensitive material having the property for discriminating the both sides thereof but not for deviating from general practice.

The foregoing and other objects of the present invention have been attained by a silver halide photographic material comprising a silver halide emulsion layer and a protective layer on the one side of the support thereof and a non-photosensitive back layer on the other side of the support thereof, wherein the amount of silver halide comprised in said silver halide emulsion layer is not more than 30 mg/dm$^2$ calculated in terms of silver amount, and a matting agent in an indeterminate form is comprised in said protective layer, and further a substantially spherical matting agent is comprised in said back layer.

The silver halide photosensitive materials of the present invention will be explained hereunder more specifically.

The aforesaid silver halide photosensitive materials comprise a silver halide emulsion layer and a protective layer on one side thereof and a non-photosensitive back layer on the other side thereof. And, they are characterized in containing matting agent in an indeterminate form in said protective layer and also containing substantially spherical matting agent in said back layer.

As for the aforesaid supports to be used in the silver halide photosensitive materials of the present invention, there are included therein as the typical supports, for example, cellulose nitrate film, cellulose acetate film, cellulose acetate butylate film, cellulose acetate propionate film, polystyrene film, polyethylene terephthalate film, polycarbonate film and the like, and these supports amy be selected suitably so as to answer the purposes of using each of the photosensitive materials. In case that the adhesion of said support to a silver halide emulsion layer is not satisfactory, a layer having the adhesion to the both of the support and the emulsion layer may be provided as a sublayer, or a surface treatment made by light, heat, strong acid, corona discharge or the like may be provided to increase the adhesion thereto.

The silver halide photosensitive material of the present invention has at least one of the silver halide emulsion layers on one side of the support thereof, as described above, and the said silver halide emulsion layer comprises gelatin to serve mainly as the binder and the photosensitive layer into which photosensitive silver halide, chemical sensitizer, spectral sensitizer, antifoggant, high contrast accelerator, gelatin hardener, surface active agent, physical property improving agent for film, viscosity thickener, halftone improving agent and the like.

The photosensitive silver halide which is contained in said silver halide emulsion layer, is silver chloride, silver bromide, silver iodide, silver chlorobromide, silver iodobromide, silver chloroiodobromide, or the like, for example. These photosensitive silver halide emulsion can be prepared through a publicly known process. They may be, for example, conversion emulsion, Lippmann emulsion, covered-grain emulsion or emulsion to which photographic fog is given optically or chemically, and may also be selectable according to the kinds or uses of said photosensitive materials. These photosensitive silver halide can be chemically sensitized by making independent or joint use of active gelatin, sulphuric sensitizer, reduction sensitizer, noble metal sensitizer and the like among these chemical sensitizers, as for the sulphuric sensitizer, allylthiocarbamide, thiourea, cystine, hypo, and the like are given concletely; as for the reduction sensitizers, stannous salt, polyamine, hydrogen and the like are given; and as for the noble metal sensitizers, there are given a variety of gold sensitizers and the sensitizers comprising water-soluble salt such as ruthenium, rhodium, iridium and palladium.

Further, the said silver halide can be sensitized optically into the desired range of wave length. For example, it is possible to sensitize (or, to supersensitization) optically by making independent or joint use of the optical sensitizer such as cyanine dye, stylyl dye, hemicyanine dye, triphenyl methane dye, xanthene dye, oxonol dye or merocyanine dye.

As described above, the photosensitive layer is formed by dispersing photosensitive silver halide in binder comprising a suitable hydrophilic colloid, and the said hydrophilic colloid is used not only in said photosensitive layer but also in the layer configuration of various photographic construction elements such as a protective layer and a back layer. As for the hydrophilic colloids, gelatin is the most desirable and gelatin can also be jointly used, in occasion demands, with other polymers such as derivative gelatin, colloidal albumin, agar, gum arabic, alginic acid, cellulose derivative, acrylamide, imidized polyacrylamide, casein, vinyl alcohol polymer, polyvinyl alcohol, polyvinyl pyrolidone, hydrolyzed polyvinyl acetate.

Also, for the purpose of improving the physical properties of a photographic configuration layer comprising the aforesaid hydrophilic colloid, it is possible to jointly use a variety of the agents for improving the physical properties of film such as a film hardener, in occasion demands. When the film hardener of this kind is jointly used, it is possible to improve the mechanical strength of a coated film and the property of the dissolution resistance thereof against a processing solution without any damage on the proper adhesion of layers, and the photosensitive materials having the exceedingly excellent physical property of film can thus be obtained.

Now in the case that gelatin is used to serve as hydrophilic colloid, the conclete examples of the typical film hardners can be given the various kinds thereof such as the one of aldehyde, ethyleneimine, active halogen, vinyl sulfone, isocyanate, sulfonate, carbodiimide, mucochloric acid, or acyloyl. Not only the aforegoing hardners, many kinds of organic or inorganic gelatin hardners can widely be added independently or combinedly with each other, and they have been indicated in the articles to T. H. James, "The Theory of the Photographic Process", 3rd ed., 1966 and described in Japanese Patent Open to Public Inspection No. 70426/1978.

Further, in order to avoid the change of sizes and the bend of a film caused by the changes of temperature or humidity, there are popularly used the process by which various kinds of polymer latexes are contained in binders so as to soften the aforesaid layer forming binders, and it is possible to contain them also in the silver halide emulsion layers used in the present invention. The various kinds of polymer latexes have been detailedly described in, for example, U.S. Pat. Nos. 2,376,005; 2,763,625; 2,772,166; 2,852,386; 2,853,457; and 3,397,988.

Still further, surface active agent can be used to serve as a coating assistant in the hydrophilic colloid layer of the silver halide photosensitive materials relating to the present invention. The said surface active agents include cationic surface active agent, anionic surface active agent, amphoteric surface active agent, nonionic surface active agent, as well as natural surface active agents such as saponin, and, to be concrete, as for the cationic surface active agents, there are given heterocyclic compounds such as higher alkylamines, quaternary ammonium salts and pyridine, phosphonium or sulfonium; as for the anionic surface active agents, there are given carbonic acid, sulfonic acid, phosphoric acid, sulfate, and phosphate; as for the amphoteric surface active agents, there are given amino acids, aminosulfonic acids and sulfate of amino alcohol; and as for the nonionic surface active agents, there are given alkylene oxide, glycerol, and glycidol, all of which are known. These surface active agents can be used independently or mixedly together and they have not only effect of serving as a coating assistant but also the effects of emulsifiedly dispersion and electric charge prevention.

The silver halide contents in a photosensitive silver halide emulsion layer having the above-mentioned constitutional elements, are limited to relatively small contents thereof in the invention, ie. not more than 30 $mg/dm^2$ in terms of silver amfount. And, a protective layer is arranged on the other surface layer of the silver halide emulsion layer and a nonphotosensitive inner surface layer (i.e., a back layer) is arranged on the other side of the support.

The aforesaid protective layer is a layer of which the binder is of hydrophilic colloid such as gelatin, and thickener, gelatin hardener, surface active agent, ultraviolet ray absorbent, or electric charge prevention agent as well as matting agent can be contained therein.

The thickness of the aforesaid protective layer used in the invention is 0.1–3 μm. As for the matting agent being contained in the said protective layer, fine powders in an indeterminate form are used for. The each fine powder is of the order of 0.1 μm–20 μm in the average grain diameter, preferably 1–10 μm therein, and the each substance of said powders has neither a plane of symmetry nor point of symmetry. To be concrete, they are given the inorganic fine powders of barium sulfate, desensitized silver halide, zinc dust, manganese colloid, titanium dioxide, silicon dioxide, magnesium oxide, calcium carbonate or the like. For further example, silicon dioxide such as synthetic silica obtained through the wet method or by gelation of silicic acid, and titanium dioxide (of rutile-type or anatase-type) formed by titanium slags and sulfuric acid. Also, the said fine powders can be obtained by pulverizing inorganic substance of which the grain diameter is relatively larger, namely, larger than 20 μm thereof, and then by classifying them.

Besides the above, there can be given the pulverized and classified matters of the organic high molecular compounds such as polytetrafluoroethylene, cellulose acetate, polystyrene, polymethyl methacrylate, polypropyl methacrylate, polymethyl acrylate, polyethylene carbonate and starch. Each of the above given matting agents in an indeterminate form can be used independently or jointly with each other. The amount added of the said matting agent in an indeterminate form is 0.1%–10% at the ratio, by weight, to the amount of hydrophilic colloid in the protective layer, particularly 0.5%–5% thereof is desirable.

On the other hand, the aforesaid back layer relating to the present invention is a layer of which the binder is made of hydrophilic colloid such as gelatin and is the non-photosensitive without containing any photosensitive silver halide but includes a single layer construction in which matting agent, electric charge prevention agent, thickening agent, gelatin hardener, surface active agent, dyes and the like, or, a multilayer construction having an interlayer, protective layer, etc.

And, the thickness of the back layer of the aforesaid constitution is 1–10 μm, and the matting agent being contained in the back layer is used in a spherical form, substantially.

The substantially spherical matting agents are preferably to have the average grain diameter of the range between 0.1 μm and 20 μm, particularly 1 μm–10 μm, and a high molecular compound synthesized through the suspension polymarization method, or, a high molecular or inorganic compound spherically shaped through the spray-dry method, etc., particularly a high molecular compound synthesized through the suspension polymerization method is preferable.

Here are given the concrete examples of the monomers of the synthetic high molecular compounds among the aforesaid matting agents which are to be contained in the back layers of the present invention.

There can be given styrene and the styrene derivatives thereof such as styrene, o-methyl styrene, m-methyl styrene, p-methyl styrene, p-ethyl styrene, 2,4-dimethyl styrene, p-butyl styrene, p-tert-butyl styrene, p-hexyl styrene, p-octyl styrene, p-nonyl styrene, p-decyl styrene, p-dodecyl styrene, p-methoxy styrene, p-phenyl styrene, p-chlor styrene, 3,4-dichlor styrene; and, as for the vinyl monomers, etylene unsaturated monoolefin such as ethylene, propylene, butylene and isobutylene, halogenized vinyls such as vinyl chloride, vinylidene chloride, vinyl bromide and vinyl fluoride, vinyl esters such as vinyl acetate, vinyl propionate, vinyl benzoinate and vinyl butyrate, α-methylene aliphatic monocarboxylic ester such as methyl acrylate, ethyl acrylate, butyl acrylate, isobutyl acrylate, propyl acrylate, octyl acrylate, dodecyl acrylate, 2-ethylhexyl acrylate, stearyl acrylate, 2-chlorethyl acrylate, phenyl acrylate, α-methyl chloracrylate, methyl methacrylate, ethyl methacrylate, propyl methacrylate, butyl methacrylate, isobutyl methacrylate, octyl methacrylate, dodecyl methacrylate, 2-ethylhexyl methacrylate, stearyl methacrylate, phenyl methacrylate, dimethylaminoethyl methacrylate and diethylaminoethyl methacrylate, acrylic or methacrylic acid derivatives such as acrylonitrile, methacrylonitrile and acrylamide, vinyl ethers such as vinyl methyl ether, vinyl ethyl ether and vinyl isobutyl ether, vinyl ketone such as vinyl methyl ketone, vinyl hexyl ketone and methyl isobutyl ketone, N-vinyl compounds such as N-vinyl pyrrole, N-vinyl carbazole, N-vinyl indole and N-vinyl prolidone, and vinyl naphthalene.

These vinyl monomers may be made into matting agents by making use of independently polymerized polymers or may be used by making them into matting agents of copolymers which are polymerized combinedly with a plurality of monomers. And the amount added to these matting agents is 0.1%–10%, by weight, to the amount of the hydrophilic colloids in a back layer, particularly 0.5%–5% thereof is preferable.

The matting agent of the present invention is contained in both the protective layer and the back layer as described above, and said matting agents contained in said layers do not always follow that they are buried under both of the said layers, but there may be some instances where they protrude from the outer surface of a layer or where they precipitate down or diffuse to the neighboring layer thereof and some grains of said matting agents remain in the protective layer or the back layer, and the present invention includes the embodiments of these sorts too.

And, in the present invention, the embodiments of the expression, "a matting agent in an indeterminate form is contained in a protective layer", include the embodiment in which a coating composite for protective layer used containing the aforesaid matting agent dispersed is coated at the same time with a coating composite for the sublayer of a protective layer use, or is coated after the coating composite for the sublayer of a protective layer use was coated, then dried up and thus a layer is obtained; and also includes the embodiment in which a matting agent is sprayed over the surface of the layer provided by coating with a coating composite for protective layer use at any arbitrary time before said layer thus provided, and the matting agent is firmly adhered to the said layer after dried up.

Similarly, the embodiments of the expression, "a matting agent is contained in a non-photosensitive back layer", include the embodiment, wherein a matting agent is contained in the coating composite to be used for at least one layer out of the layers configurated the said back layer, and the coating and the drying are made, and thus a layer is obtaned; and also include the embodiment, wherein, after the top surface layer of the said back layer was coated but before it is dried up, a matting agent is sprayed over the surface of said layer, and after the said layer was dried up, the matting agent is firmly adhered to the surface of said back layer.

Further, in the present invention, it is possible to contain in said protective layer with the additives such as ultraviolet ray absorbent, softening agent, antistatic agent, whitening agent, antioxidant, developing speed regulator, viscosity thickener, pH regulator, film hardener and surface active agent, besides the said matting agent. And, into the said back layer, it is possible to contain, besides the said matting agent, antistatic agent, viscosity thickener, film hardner, surface active agent, dyes, softener, etc.

The silver halide photosensitive materials provided by the present invention, of which the detail is described herein, can be developed by making use of a black-and-white photographic developers which are popularly used for developing graphic arts photosensitive materials, for example, lith developers, phenidone. hydroquinone developer (PQ Developer), metol:hydroquinone developer (MQ Developer), etc.

The silver halide photosensitive materials of the present invention were constituted as mentioned above, therefore, the emulsion layer side thereof was greater than the back layer in the mat degree and superior in the both sides discrimination and moreover, not only any pinholes was not produced but also the adhesion property, antistatic property, vacuum adhesion property and the like were improved.

The following is the concrete description of the silver halide photosensitive materials of the present invention with the reference of the examples thereof, it is, however, to be understood that the present invention shall not be limited thereto.

EXAMPLE 1

In a gelatin binder, a lith type silver chloroiodobromide emulsion containing 26 mol% of silver bromide and 0.1 mol% of silver iodide, which serves as a silver halide, is added with gold sensitizer and sulphur sensitizer, and then chemically sensitized, and further optically sensitized by making use of 1-carboxymethyl-5-[(3-ethyl-2-benzoxazolinidine)-ethylidene]-3-phenyl-2-thiohydantoin. Next, the emulsion thus obtained was stabilized by 4-hydroxy-1,3,3a,7-tetrazaindene, and the addition was made respectively with polymer latex for a softening agent, saponin for a coating assistant, potassium polystylene sulfonate for a viscosity thickener, formalin for a film hardener and the like, and thereafter the coating was made over to a sublayered polyethylene terephthalate film (of which the thickness was 100 μm) so that the amount coated of silver can be 25 mg/dm$^2$ in term of the silver amount. To prepare the protective layer of said emulsion layer, gelatin was used to serve as a binder similarly to the above, and the same kinds of thickener, coating assistant, softener, hardner, etc. which are to be added in the protective layer, were used as in the case of said emulsion layer preparation. As for the matting agent, each kind of compounds shown in the following Table 1, was used therein. The non-photosensitive back layer (back layer) was prepared by making use of same kinds of gelatin, thickener, coating assistant, softener, hardner, etc., as in the case of the aforesaid emulsion layer preparation. And, into the back layer thereof, the mixture of the following dyes, [I], [II] and [III] were added together to serve as the dyes, and each of the compounds shown in Table 1 was added to serve as the matting agent.

Dye [I]

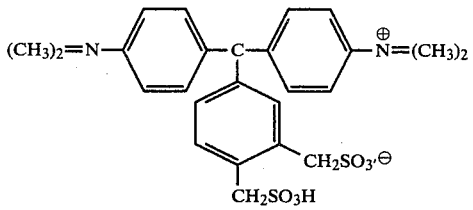

Dye [II]

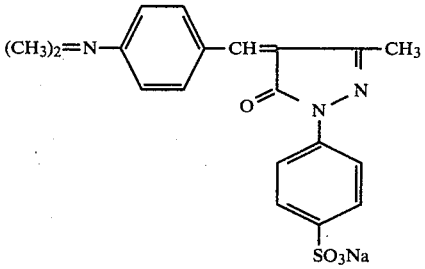

Dye [III]

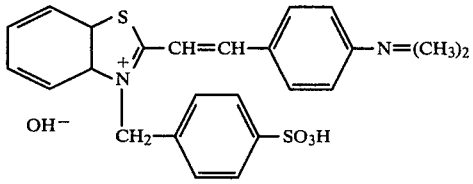

TABLE 1

| Sample No. | Additive to Protect Layer | Amount added (%) | Additive to Back Layer | Amount added (%) |
|---|---|---|---|---|
| 1 (Control) | Silicon dioxide | 5 | Silicon dioxide | 1 |
| 2 (Control) | Titanium dioxide | 5 | Titanium dioxide | 1 |
| 3 (Control) | Silicon dioxide | 1 | Silicon dioxide | 5 |
| 4 (Control) | Titanium dioxide | 1 | Titanium dioxide | 5 |
| 5 (Control) | Silicon dioxide | 2 | Silicon dioxide | 2 |
| 6 (Control) | Methyl polymeth-acrylate a | 5 | Methyl polymeth-acrylate a | 1 |
| 7 (Control) | Polymethyl styrene a | 5 | Polymethyl styrene a | 1 |
| 8 (Control) | Methyl polymeth-acrylate a | 1 | Methyl polymeth-acrylate a | 5 |
| 9 (Control) | Polymethyl styrene a | 1 | Polymethyl styrene a | 5 |
| 10 (Invention) | Silicon dioxide | 2 | Methyl polymeth-acrylate a | 2 |
| 11 (Invention) | Titanium dioxide | 2 | Polymethyl styrene a | 2 |
| 12 (Invention) | Silicon dioxide | 2 | Propyl polymeth- | 2 |

TABLE 1-continued

| Sample No. | Additive to Protect Layer | Amount added (%) | Additive to Back Layer | Amount added (%) |
|---|---|---|---|---|
| | | | acrylate a | |
| 13 (Invention) | Titanium dioxide | 2 | Butyl polyacrylate a | 2 |
| 14 (Invention) | Polymethyl styrene b | 2 | Propyl polymethacrylate a | 2 |
| 15 (Invention) | Methyl polymethacrylate b | 2 | Methyl polymethacrylate a | 2 |
| 16 (Invention) | Butyl polyacrylate b | 2 | Propyl polymethacrylate a | 2 |

For reference, the amount added shown in the above table indicates in term of the percentage, by weight, to the amount of gelatin binder used in each sample therein. And, Sample Nos. 1–9 are the control samples and Nos. 10–16 are the samples prepared by the present invention.

Also, silicon dioxide shown in the above table, which was used to serve as the matting agent, was the fine powder in an indeterminate form that was synthesized by the alkaline fusing of quartz sands and soda ashes, and the average grain diameter thereof was 3.5 μm. Titanium dioxide thereof was the fine powder in an indeterminate form, which was prepared through the process, wherein the raw ore was industrially turned into a sulfate by making use of sulfuric acid and then baked, and the matter thus baked was pulverized to obtain said powder; and, the distribution of the grain diameter thereof was within the range of 0.1–5 μm.

Further, among the above synthetically polymerized compounds, each of methyl polymethacrylate a, polymethyl styrene a, propyl polymethacrylate a and butyl polyacrylate a was in the spheric form and the average grain diameter thereof was 3.0–4.0 μm; and each of polymethyl styrene b, methyl polymethacrylate b and butyl polyacrylate b was the classified pulverized matter in an indeterminate form and the average grain diameter thereof was 3.0–3.5 μm that is being used to serve as a matting agent.

Still further, in the control samples from Sample No. 1 to No. 5, a matting agent in an indeterminate form was used in both of the each protective layer and the back layer thereof, and in contrast therewith, in the control samples from Sample No. 6 to No. 9, a matting agent in a spherical form was used in both layers thereof.

The samples into which the various kinds of the matting agents shown in Table 1 were exposed thoroughly to light so that said samples can be solidly darkened, and then developed them by making use of Sakuradol CDL-271 (Lith developer, mfd. by Konishiroku Photo Ind. Co., Ltd.), and thus the mat-degree (i.e., the both sides discrimination) and the mat-pins of both emulsion layer and back layer were evaluated.

The results thus obtained are shown in Table 2. Wherein, the evaluation of the mat-degrees are indicated respectively by the marks; (+): mat degree of the emulsion layer was higher, (0): mat degrees of the emulsion layer and the back layer were almost equal, and (−): mat degree of the back layer was higher. The general practice in graphic arts films represents the mark (+). And, wherein, the number of pinholes produced was counted in terms of the unit area of 1 $cm^2$ and said counted number is indicated respectively by the marks; ( ): Not produced at all, (+): Produced two pins or less, (−): Produced five or less, and (=): Produced six or more.

TABLE 2

| Sample No. | Mat-Degree | Amount Produced of pinholes |
|---|---|---|
| 1 | + | − |
| 2 | + | = |
| 3 | − | ++ |
| 4 | − | + |
| 5 | 0 | + |
| 6 | + | − |
| 7 | + | − |
| 8 | − | ++ |
| 9 | − | ++ |
| 10 | + | ++ |
| 11 | + | + |
| 12 | + | ++ |
| 13 | + | + |
| 14 | + | ++ |
| 15 | + | ++ |
| 16 | + | ++ |

Wherein, as indicated by Sample Nos. 10–16 of the present invention, in the case that an indeterminately formed matting agent was used in a protective layer and a spherically formed matting agent was substantially ued in a back layer, it is clearly shown the fact that it is possible to obtain silver halide photosensitive materials of which the both sides discrimination property is excellent and in which no pinhole is produced at all. And, at the same time, in the above Sample Nos. 10–16, it has obtained the results that the adhesiveness was less and that the antistatic property and the vacuum adhesion property were extremely excellent.

What we claim is:

1. A silver halide photographic material comprising a support, a silver halide emulsion layer and a protective layer on one side of said support, and a non-photosensitive back layer on the other side of said support wherein silver halide is present in said silver halide emulsion layer in an amount not greater than 30 $mg/dm^2$ based on the amount of silver, and a first matting agent in said protective layer and a substantially spherical matting agent in said back layer, wherein said first matting agent comprising a fine powder of an inorganic compound selected from the group consisting of barium sulphate, desensitized silver halide, zinc dust, manganese colloid, titanium dioxide, silicon dioxide, magnesium oxide and calcium carbonate or a an organic high molecular weight compound selected from the group consisting of polytetrafluoroethylene, cellulose acetate, polystyrene, polymethylstyrene, polymethylmethacrylate, polypropylmethacrylate, polymethylacrylate, butyl polyacrylate and polyethylenecarbonate, and wherein said spherical matting agent is an organic high molecular weight compound obtained by suspension polymerization thereof.

2. A silver halide photographic material according to claim 1, wherein the matting agent in an indeterminate form has neither a plane of symmetry thereof or a point of symmetry thereof.

3. A silver halide photographic material according to claim 1 or 2, wherein the amount added of the matting agent in an indetermnate form is 0.1–10% by weight to the amount of the protective layer.

4. A silver halide photographic material according to claim 1 or 2, wherein the matting agent in an indeterminate form has an average grain diameter of 0.1–20 μm.

5. A silver halide photographic material according to claim 1, wherein the substantially sherical matting agent has an average grain diameter of 0.1–20 μm.

6. A silver halide photographic material according to claim 1 or 5, wherein the amount added of the substantially spherical matting agent is 0.1–10% by weight to the amount of the back layer.

* * * * *